US012491599B2

(12) United States Patent
Rothwell

(10) Patent No.: US 12,491,599 B2
(45) Date of Patent: Dec. 9, 2025

(54) TRIMMING TOOL AND METHOD OF USE

(71) Applicant: Jordan Byron Rothwell, Burlington (CA)

(72) Inventor: Jordan Byron Rothwell, Burlington (CA)

( * ) Notice: Subject to any disclaimer, the term of this patent is extended or adjusted under 35 U.S.C. 154(b) by 1439 days.

(21) Appl. No.: 16/044,690

(22) Filed: Jul. 25, 2018

(65) Prior Publication Data

US 2019/0030674 A1 Jan. 31, 2019

Related U.S. Application Data

(60) Provisional application No. 62/536,705, filed on Jul. 25, 2017.

(51) Int. Cl.
*B24B 7/18* (2006.01)
*B24B 23/02* (2006.01)
(Continued)

(52) U.S. Cl.
CPC ..... *B24B 7/182* (2013.01); *B24B 7/188* (2013.01); *B24B 23/02* (2013.01); *B24B 41/002* (2013.01);
(Continued)

(58) Field of Classification Search
CPC ..... B24B 7/182; B24B 7/188; B24B 7/186; B24B 41/002; B24B 41/047; B24B 55/102; B24B 55/105; B24B 55/052; B24B 23/02; B24B 45/00; B24B 45/003; B24B 45/006; B24B 55/10; B24B 55/05; B24B 55/04; B24D 5/06; B24D 5/16; B24D 7/16; B24D 7/06; B24D 2203/00; B23C 2226/62; Y10T 409/304088; Y10T 409/306608
(Continued)

(56) References Cited

U.S. PATENT DOCUMENTS 1,368,131 A 2/1921 Fluor
1,883,392 A * 10/1932 Moll ..... B27C 5/10 144/136.95
(Continued)

FOREIGN PATENT DOCUMENTS

CA 2097788 5/1997
DE 3425764 1/1986
(Continued)

OTHER PUBLICATIONS

DE10356731B3 EspaceNet Translation (Year: 2005).*
(Continued)

*Primary Examiner* — Makena S Markman
(74) *Attorney, Agent, or Firm* — Carlson, Gaskey & Olds, P.C.

(57) ABSTRACT

An example trimming tool includes a floating base having a first side and an opposite, second side, a first rail, and a second rail. At least the second side of the floating base, the first rail and the second rail define a workspace having a first opening and a second opening. The trimming tool also includes a milling apparatus, attached to the floating base, having a base on the first side of the floating base and a milling head on the second side of the floating base. The milling head is spring loaded. The floating base and milling apparatus are configured to remove at least a portion of a foam layer in the workspace.

19 Claims, 7 Drawing Sheets

(51) Int. Cl.

| | |
|---|---|
| ***B24B 41/00*** | (2006.01) |
| ***B24B 41/047*** | (2006.01) |
| ***B24B 55/05*** | (2006.01) |
| ***B24B 55/10*** | (2006.01) |
| ***B24D 5/06*** | (2006.01) |
| ***B24D 5/16*** | (2006.01) |
| ***B24D 7/06*** | (2006.01) |
| ***B24D 7/16*** | (2006.01) |

(52) U.S. Cl.
CPC ..... *B24B 41/047* (2013.01); *B24B 55/052* (2013.01); *B24B 55/102* (2013.01); *B24D 5/06* (2013.01); *B24D 5/16* (2013.01); *B24D 7/06* (2013.01); *B24D 7/16* (2013.01); *B24D 2203/00* (2013.01)

(58) Field of Classification Search
USPC ..... 451/451, 453, 454, 455, 456, 344, 541
See application file for complete search history.

(56) References Cited

U.S. PATENT DOCUMENTS 3,159,514 A 12/1964 McKnight, Jr. et al.
3,440,121 A 4/1969 Shockey
3,548,453 A 12/1970 Garis
3,785,913 A 1/1974 Hallamore
3,796,593 A 3/1974 Finelli et al.
3,879,908 A 4/1975 Weismann
3,882,644 A * 5/1975 Cusumano ..... A47L 11/4077 451/359
3,991,252 A 11/1976 Kolakowski et al.
4,076,778 A 2/1978 Whitting
4,093,411 A 6/1978 Lee
4,259,028 A 3/1981 Cook
4,342,181 A 8/1982 Truesdell
4,343,088 A * 8/1982 Farley ..... B23D 45/003 409/184
4,409,699 A * 10/1983 Moorhouse ..... A47L 7/0095 144/252.1
4,409,768 A 10/1983 Boden
4,471,591 A 9/1984 Jamison
4,488,383 A * 12/1984 Zerbe ..... B24B 23/02 144/136.95
4,550,543 A 11/1985 Valenzano
4,814,036 A 3/1989 Hatch
5,146,965 A * 9/1992 Gibson ..... B44B 3/061 144/144.1
5,192,598 A 3/1993 Forte et al.
5,389,167 A 2/1995 Sperber
5,411,433 A * 5/1995 Keller ..... B24B 55/102 451/451
5,669,371 A * 9/1997 Rupprecht ..... B28D 1/183 125/13.01
5,787,665 A 8/1998 Carlin et al.
5,957,765 A * 9/1999 Kimbel ..... B24B 23/02 451/358
6,026,629 A 2/2000 Strickland et al.
6,099,768 A 8/2000 Strickland et al.
6,119,422 A 9/2000 Clear et al.
6,322,869 B1 11/2001 Dietrich
6,415,580 B2 7/2002 Ojala
6,470,930 B1 * 10/2002 Stottmann ..... B23Q 11/0046 144/251.2
6,491,575 B2 * 12/2002 Sarantitis ..... B24B 7/186 144/118
D470,736 S 2/2003 Lopano
6,568,088 B1 * 5/2003 Ende ..... B23D 47/02 30/390
6,584,749 B2 7/2003 Sperber
6,727,290 B2 4/2004 Roth
D531,871 S 11/2006 Etter et al.
7,168,216 B2 1/2007 Hagen, Jr.
7,490,642 B1 2/2009 Cooper et al.
D588,428 S 3/2009 Etter et al.
7,574,837 B2 8/2009 Hagen, Jr. et al.
8,220,162 B2 * 7/2012 Rayner ..... B26D 1/205 30/240
8,480,457 B2 * 7/2013 Kundel, Jr. ..... B24B 55/102 451/340
8,777,698 B2 * 7/2014 O'Shannessy ..... B25H 1/0021 451/344
10,201,889 B2 * 2/2019 Morris ..... B24B 23/02
10,259,094 B2 * 4/2019 Toberman ..... B24B 7/10
10,569,375 B2 * 2/2020 Ikai ..... B23Q 11/0883
2003/0056853 A1 * 3/2003 Gass ..... F16P 3/12 144/154.5
2005/0079809 A1 * 4/2005 Zayat ..... B44D 3/16 451/359
2008/0127600 A1 6/2008 Schiffmann et al.
2009/0298402 A1 * 12/2009 Guillen Cobos ..... B24B 55/06 451/388
2011/0036030 A1 2/2011 Hegland
2011/0138724 A1 6/2011 Olang
2011/0275293 A1 * 11/2011 Eto ..... B24B 55/05 451/453
2019/0118329 A1 * 4/2019 Eisenmann ..... B24B 23/02
2019/0160622 A1 * 5/2019 Barth ..... B24B 47/12

FOREIGN PATENT DOCUMENTS

DE 4315533 12/1994
DE 10356731 B3 * 3/2005 ..... B23C 5/1009
FR 2589905 5/1987
FR 2722811 1/1996
JP 2000234402 8/2000
JP 2002188242 7/2002

OTHER PUBLICATIONS

Dynabrade Manual for Router Models: 51330, 51331, Version PD03 12R, Published Mar. 18, 2016. See pp. 1-8. (Year: 2016).*
Screengrab of the website where Dynabrade Manual was retrieved, 'Dynabrade 51330 .7 HP Router'. Mar. 18, 2016, [online], [retrieved from the internet on Jul. 7, 2022] <URL: https://dynashop.co.uk/dynabrade-51330-7-hp-router-20000-rpm-front-exhaust-38-24-spindle-thread-dynabrade-manual/> (Year: 2016).*
PCT Search Report for PCT Application No. PCT/CA2009/001151, mailed Sep. 29, 2009.
International Preliminary Report on Patentability for PCT/CA2009/001151, mailed Mar. 3, 2011.
Specification. 2-1/4 HP (Maximum Motor HP) EVS D-Handle Router with Soft Start. Retrieved Jul. 25, 2018 from: https://www.dewalt.com/en-us/products/power-tools/routers-planers-and-joiners/routers/214-hp-maximum-motor-hp-evs-dhandle-router-with-soft-start/dw618d.

* cited by examiner

TRIMMING TOOL AND METHOD OF USE

This application claims priority to U.S. Provisional Application Ser. No. 62/536,705, filed Jul. 25, 2017.

BACKGROUND

This disclosure relates to devices and methods for eliminating extraneous foam or other materials used in the construction of walls, such as insulated wall panels, and a method of doing the same.

Various methods have been used to produce foam filled wood stud walls. One particular method, developed by the Assignee of the present disclosure, is particularly suited to prefabricated walls and is described in U.S. Pat. No. 5,273,693. In that method, a half completed stud wall is introduced into an apparatus comprising a backplate and a moveable dam having a removable sheet and a compressible membrane. The exterior sheathing of the stud wall is placed against the backplate. The stud wall is backed with any suitable exterior sheathing, such as asphalt-impregnated fiber board. The removable sheet is draped over the interior of the stud wall. The compressible membrane is placed over the removable sheet and the moveable dam urges the backplate, stud wall, removable sheet and compressible membrane together. The compressible membrane forms a seal between the dam and the studs and is urged into the wall cavity reducing the volume of the cavity. Interfaces used for prefabricating panels result in large assembly lines, increasing manufacturing time and expense, and making it more difficult to retrofit existing assembly lines.

A foam or foam-forming mixture is introduced between the sheathing and the moveable dam having the removable sheet and the compressible membrane, which is temporarily positioned against the interior side of the studs. The foam or foam-forming mixture is introduced by a "spray-pour" method. In this type of method, a spray-type urethane foam is injected between the exterior sheathing and the dam using an atomizing spray nozzle having a tube to direct the trajectory of the spray. The foam is then permitted to rise freely between the sheathing and the dam and is allowed to set.

After allowing sufficient setting time to elapse, the dam is moved to the next upper unfilled section of the stud wall while the removable sheet and the compressible membrane are unrolled in advance of the moveable dam and the next bath of foam or foam-forming mixture is introduced into the wall. The wall can therefore be filled in a series of spray-pours.

More recently, the Assignee of the present disclosure developed panels that included rigid foam panels, as described in U.S. Pat. No. 8,365,497. Insulated panels include exterior sheathing, studs, rigid foam panels and spray/pour foam that is cured in place. The rigid foam panels are placed up against the sheathing between the studs, and the spray/pour foam is used to fill in the void between the studs and the rigid foam panels. In some examples, the rigid foam panels may have beveled sides, or be placed by guides or spacers. Additional layers of rigid foam panels and/or spray/pour foam may be applied over the original layer of rigid foam panels.

The application and use of the rigid foam panels, the spray/pour foam, and other foam can leave an uneven, rigid foam layer on the surface of the resulting product. The uneven, rigid foam layer results in a process to reduce the rigid foam layer flush with a stud to produce a uniform panel surface to which drywall or some other product can be fastened. The process is labour intensive and produces large chunks of scrap foam that must be manually gathered for disposal. Automating the process has proven difficult due to the lack of perfect alignment between the studs, the lack of uniformity amongst studs, and a non-uniform recess depth where the rigid foam layer is provided.

SUMMARY

In one non-limiting embodiment, a trimming tool includes a floating base having a first side and an opposite, second side, a first rail, and a second rail. At least the second side of the floating base, the first rail and the second rail define a workspace having a first opening and a second opening. The trimming tool also includes a milling apparatus, attached to the floating base, having a base on the first side of the floating base and a milling head on the second side of the floating base. The milling head is spring loaded. The floating base and milling apparatus are configured to remove at least a portion of a foam layer in the workspace.

In another non-limiting embodiment, a method of using a trimming tool includes providing a trimming tool. The trimming tool includes a floating base having a first side and an opposite, second side, a first rail, and a second rail. At least the second side of the floating base, the first rail and the second rail define a workspace having a first opening and a second opening. The trimming tool includes a milling apparatus, attached to the floating base, having a base on the first side of the floating base and a milling head on the second side of the floating base. The milling head is spring loaded. The trimming tool is moved along a surface such that at least a portion of a foam layer enters the workspace. At least a portion of the foam layer is milled such that the surface and the portion of the foam layer that is milled are flush.

These and other features disclosed herein can be best understood from the following specification and drawings, the following of which is a brief description.

DETAILED DESCRIPTION

Figure 1:
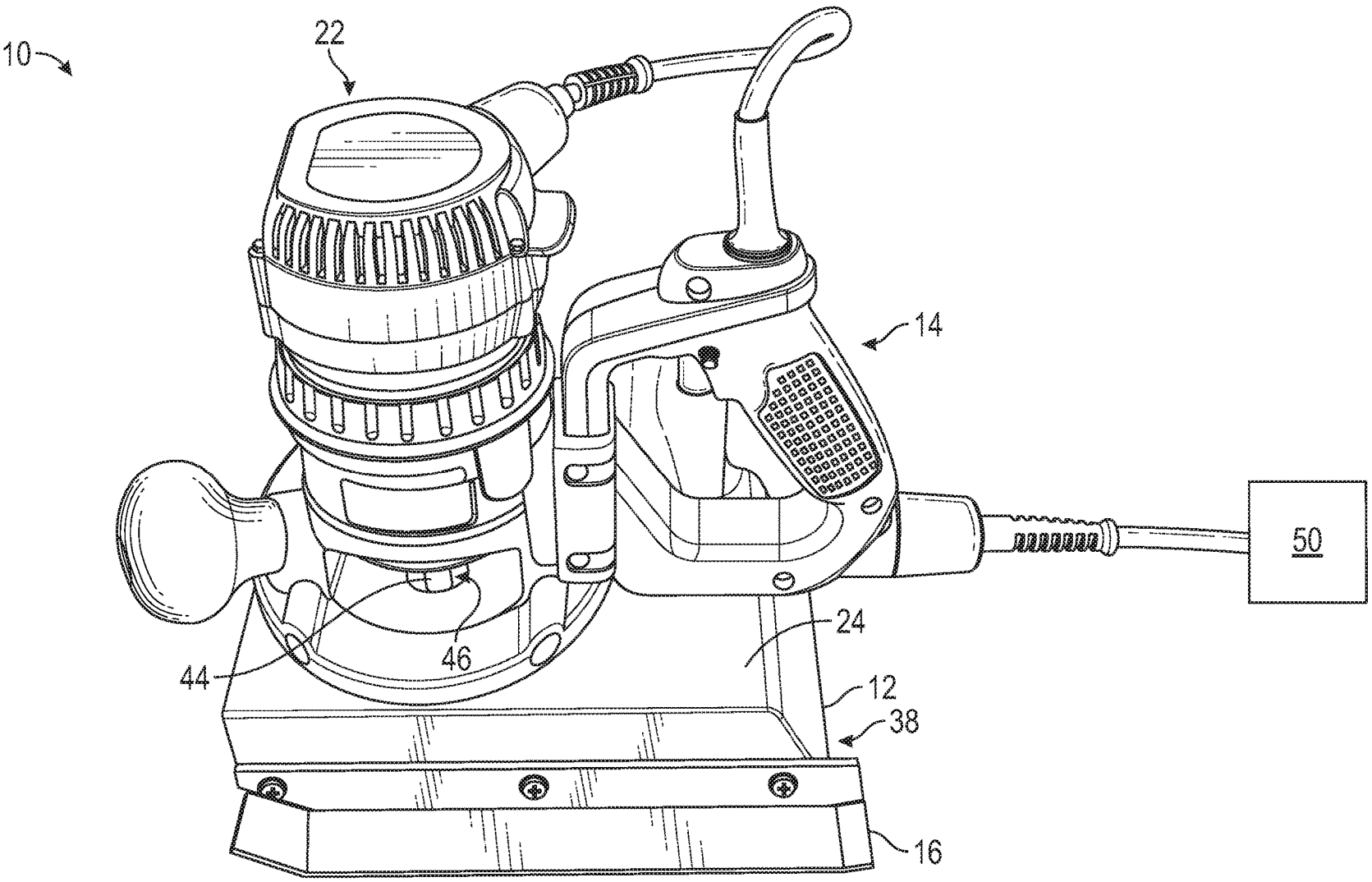
FIG. 1 is a perspective view of an example trimming tool.
Figure 2:
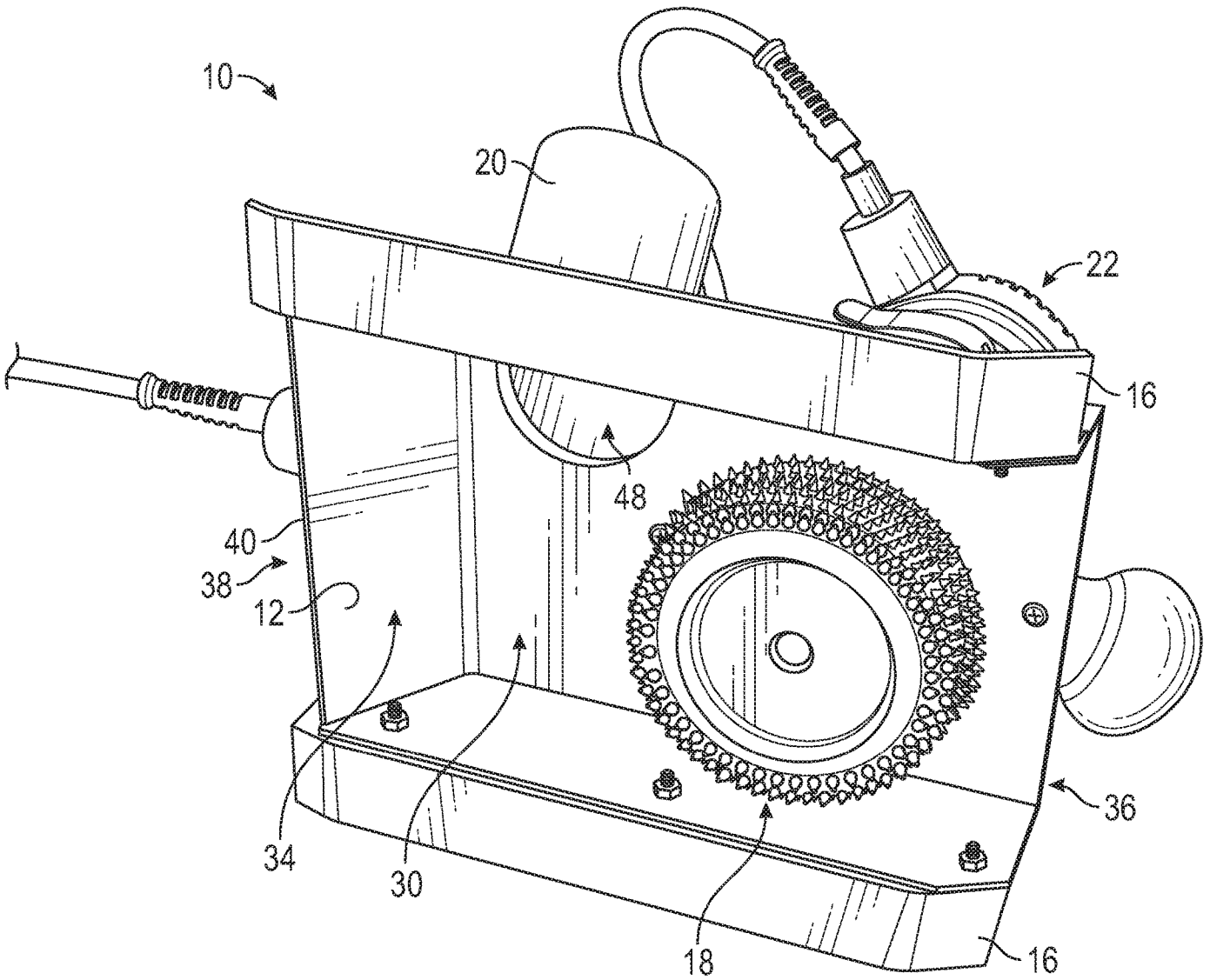
FIG. 2 is a bottom perspective view of the example trimming tool of FIG. 1.
Figure 3:
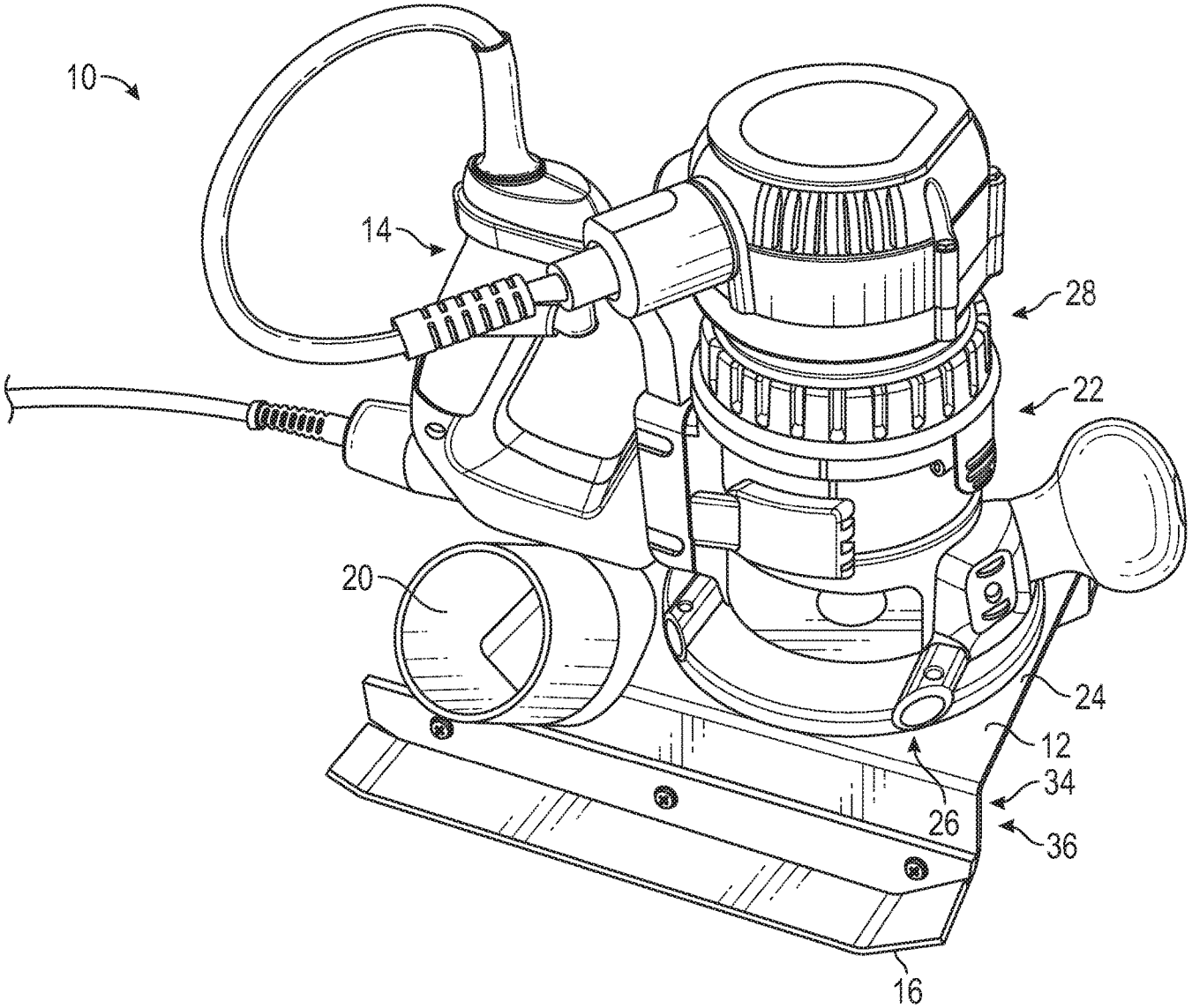
FIG. 3 is another perspective view of the example trimming tool of FIG. 1.
Figure 4:
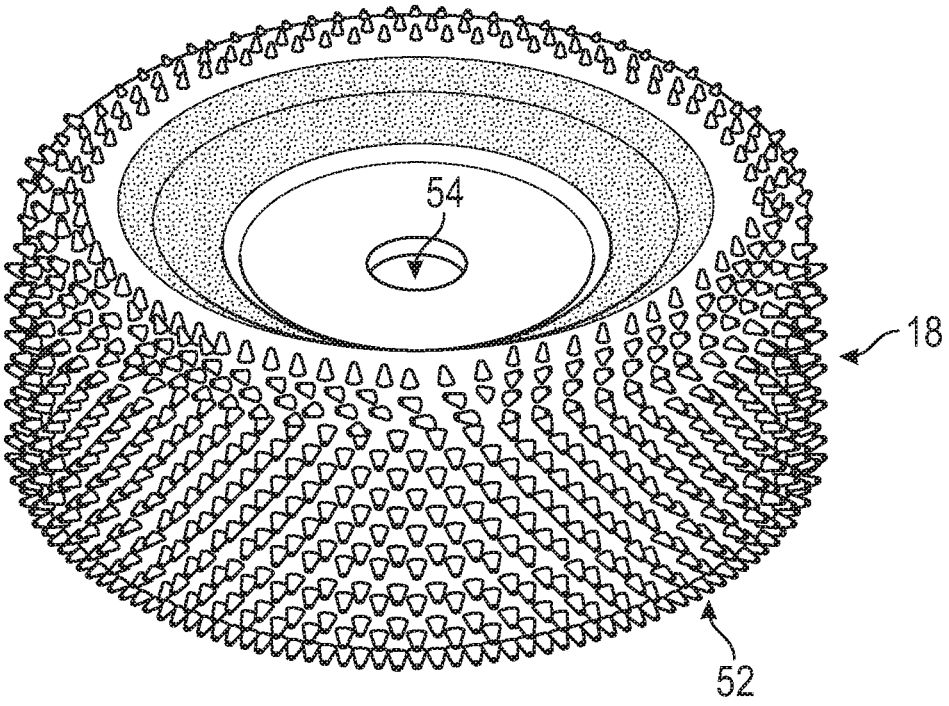
FIG. 4 is a perspective view of an example milling head and shaft.

FIGS. 1-3 illustrate a number of perspective views of a trimming tool 10 used to mill and eliminate a layer of rigid foam 110 (shown in FIG. 9), or other similar material. In one example, the layer of rigid foam 110 is a hardened spray or pour foam that is applied to a surface. The trimming tool 10 includes a floating base 12 including a collection port 20, rails 16, and a milling apparatus 22 having a handle 14, a milling head 18, a base 26 and motor 28. The milling apparatus 22 is attached to the floating base 12. The milling apparatus 22 motor 28 provides power to the trimming tool 10 so as to activate the milling head 18 in use. In one example, the handle 14 includes a trigger to activate the milling head 18. However, the milling head 18 may be activated in other ways, such as a continuous on/off switch.

The handle 14, base 26, and motor 28 of the milling apparatus 22 are disposed on a first side 24 of the floating base 12 and the milling head 18 is disposed on a second side 30 of the floating base 12. The milling head 18 is attached to the floating base 12 by a fastener 44 that extends through the milling head 18 and through an opening 46 in the floating base 12. The milling head 18 is spring loaded when it is attached to the floating base 12 to allow the milling head 18 to float on top of a stud face and mill the rigid foam layer 110. The milling apparatus 22 is connected to a power source 50. In one example, the power source 50 is an electrical outlet. In another example, the power source 50 is a battery which allows the milling apparatus to be used at any worksite.

The floating base 12 is attached to the rails 16 which provide for movement along a surface containing the layer of rigid foam, as will be described in more detail below. In one example, the rails 16 include a first rail and a second rail. However, other numbers of rails may be used. In one example, rails 16 are attached to the floating base by a plurality of screws. However, rails 16 may be attached to the floating base 12 in other applicable ways including, but not limited to, welding. In another example, rails 16 and floating base 12 form a single, unitary structure. Rails 16 include linear portions to maintain the floating base 12 against a surface, stabilize the floating base 12, and allow the floating base 12 to move along a surface with the rigid foam layer 110.

The floating base 12 and rails 16 form a workspace 34 for the milling head 18. The workspace 34 contains the operations of the milling head 18 thereby providing milling that is performed safely within the floating base 12. The workspace 34 has a front opening 36 for receiving and moving over the rigid foam layer 110. The front opening 36 is wider than the milling head 18 and is configured to receive any variation of thickness and linearity in structural framing studs 112 and rigid foam layer 110 being trimmed.

The workspace 34 further includes a rear opening 38 including an opening to allow the trimming tool 10 to move along the surface containing the rigid foam material 110. In one example, a trailing edge 40 of the rear opening 38 is about ¼ inch above the rail 16 to allow the floating base 12 to clear a trimmed stud face regardless of the variance between the relative stud face and the height of the rigid foam layer 110.

Figure 7:
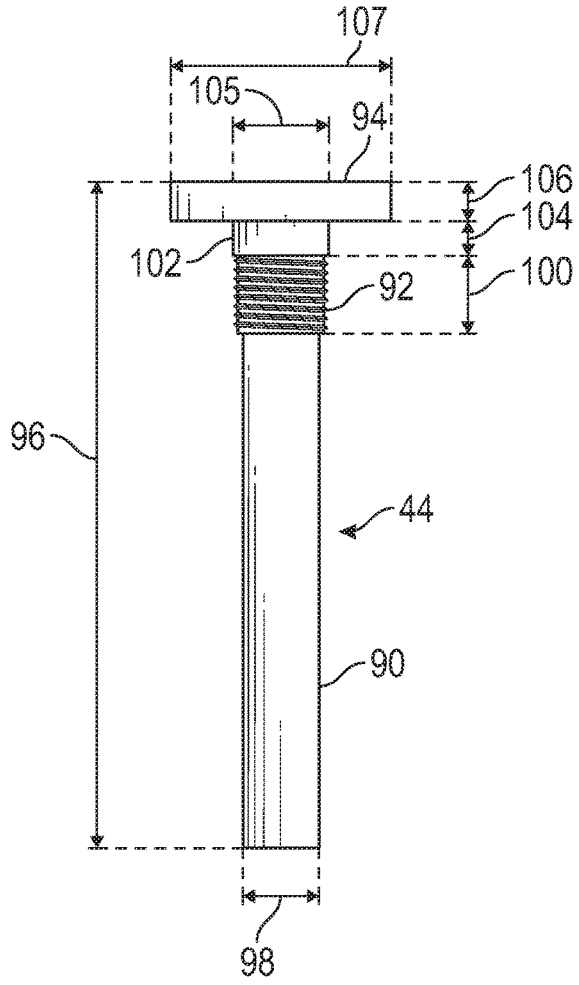
FIG. 7 is a cross sectional view of the shaft of FIG. 4.

In one example, the milling head 18 is disposed closer to the front opening 36 than the rear opening 38 to allow space for the collection of millings resulting from the milling head 18 trimming the rigid foam layer 110. In one example, the floating base 12 includes a collection port 20. The collection port 20 includes an opening 48 in the floating base 12 sized to allow chunks of millings to pass through the opening 48 and out of the workspace 34. The collection port 20 is connected to a tube 42 (as shown in FIG. 7) that provides suction to vacuum extract the millings resulting from the milling head 18 trimming the rigid foam layer 110 and deposit the millings in a desired location. The millings may be recycled or later disposed of, but are collected concurrent with the use of trimming tool 10 being used to trim the rigid foam layer 110 and without a separate process.

Referring to FIGS. 4-8, with continued reference to FIGS. 1-3, an example milling head 18 is shown. The milling head 18 is provided with an abrasive material, such as protrusions, that grinds the rigid foam layer 110 flush with a corresponding stud face. The milling head 18 is generally cylindrical with an opening through its center to receive fastener 44. The milling head 18 includes a plurality of protrusions 52 extending about the circumference of the milling head 18. In one example, the plurality of protrusions 52 are raised spikes on the surface of the milling head. The plurality of protrusions 52 are arranged in rows from one end of the milling head 18 to the other end of the milling head 18. In one example, each row of the plurality of protrusions 52 includes between 15 and 20 protrusions 52. As the milling head 18 is rotated, the plurality of protrusions 52 allow the milling head 18 to trim the rigid foam layer 110 within the workspace 34 of the trimming tool 10.

In another example the plurality of protrusions are one of a plurality of teeth or blades. In another example, more than one type of protrusion 52 can be used on the same milling head 18. Although an example arrangement of the plurality of protrusions 52 is shown, other configurations of the plurality of protrusions 52 are contemplated as long as the plurality of protrusions 52 provide the milling head a suitable manner in which to grind the rigid foam material without damaging the corresponding stud faces. In one example, milling head 18 is also provided with a protective coating that protects the surfaces of the milling head 18, including the plurality of protrusions 52 during use. In one example, the protective coating is a tape that is applied to the milling head 18.

Figure 5:
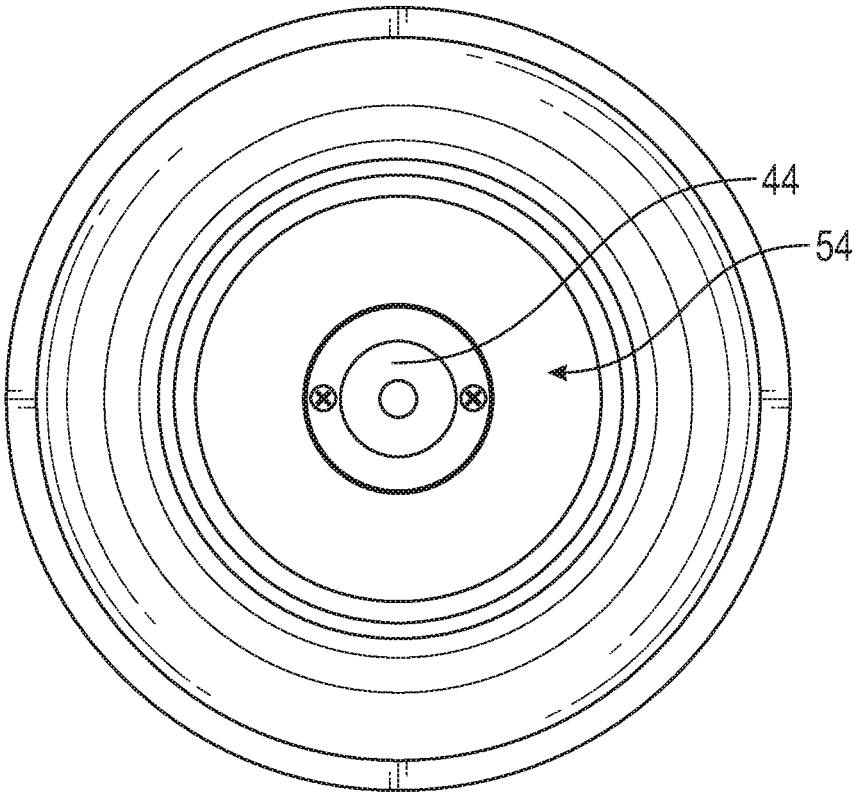
FIG. 5 is a top view of the example milling head and shaft of FIG. 4.
Figure 6:
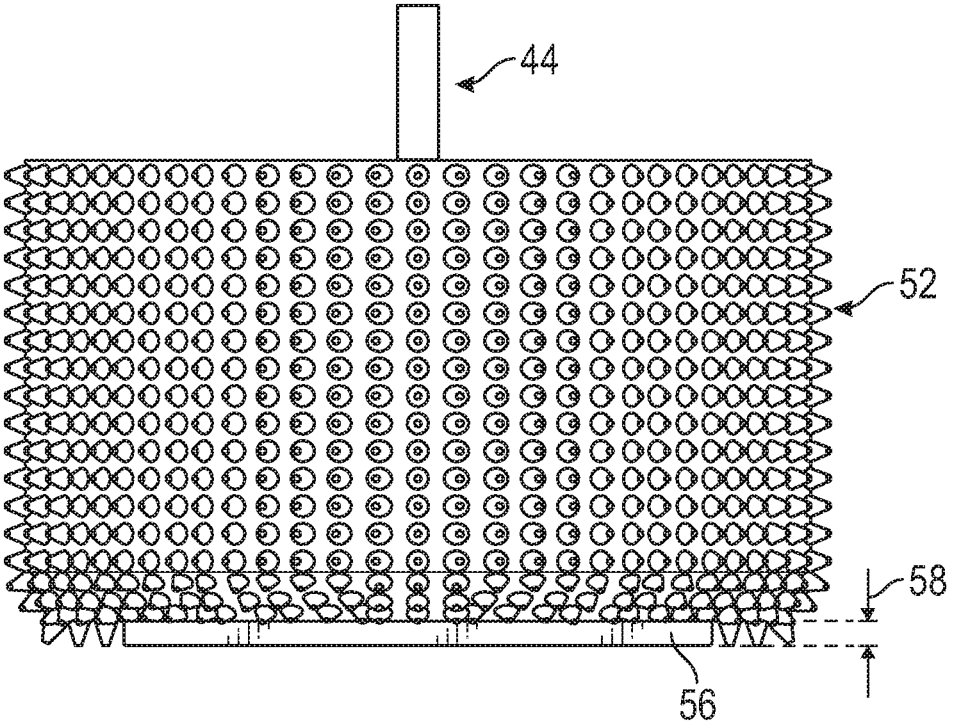
FIG. 6 is a perspective view of an example milling head with protrusions.
Figure 8:
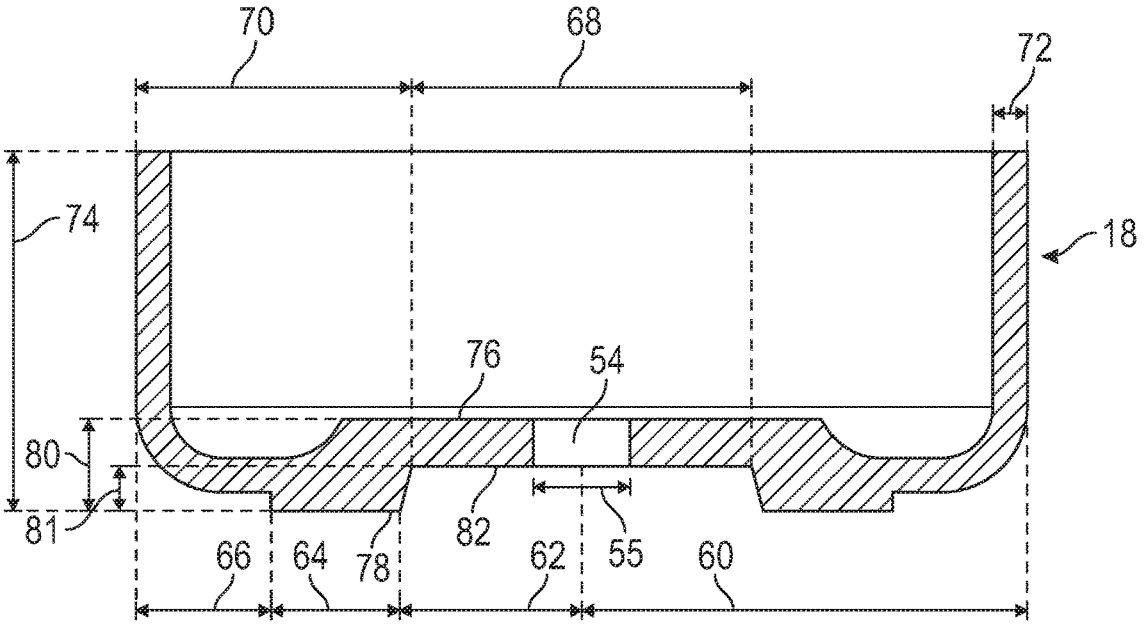
FIG. 8 is a cross sectional view of the milling head of FIG. 4.

In FIGS. 5 and 8, to show certain dimensions and features of the body of the milling head 18, the milling head 18 is shown without the plurality of protrusions 52. The milling head 18 includes an opening 54 sized to receive the fastener 44.

The milling head 18 includes a guide surface 56 that protrudes from the bottom of the milling head 18. In one example, the guide surface 56 is a smooth surface and the plurality of protrusions 52 are terminated before the guide surface 56 begins. In one example the guide surface 56 protrudes from the bottom of the milling head 18 a length equal to the length of one of the plurality of protrusions 52 on the bottom of the milling head 18.

In one example, milling head 18 includes a radius 60 of about 2½ inches. The radius 60 includes a portion 62 radially inside the guide surface 56 having a width of about 1 inch, a portion 64 that generally corresponds to the guide surface 56 having a width of about ¾ inches, and a portion 66 radially outside the guide surface 56 having a width of about ¾ inches. The milling head 18 also includes a center portion 68 with a width of about 1⅞ inches and an outer portion 70 with a width of about 1 7/16 inches. The milling head 18 includes a wall thickness 72 of about 3/16 inches. The milling head 18 includes a height 74 of about 2 inches. A length 80 between the inner surface 76 and the bottom surface 78 of the milling head 18 is about ½ inches. A length 81 between the bottom surface of the central portion 82 and the bottom surface 78 of the milling head 18 is about ¼ inches. The opening 54 of the milling head 18 has a width 55 of about ⅝ inches.

In one example, the fastener 44 includes a shaft 90, a threaded portion 92, an intermediate portion 93, and a head 94. The fastener 44 has a height 96 of about 4½ inches. The shaft 90 has a width 98 of about ½ inches. The threaded portion 92 extends a length 100 of about ½ inches. The intermediate portion 93 of the fastener 44 extends a length 104 of about ¼ inches. The head 94 has a thickness 106 of about ¼ inches. The intermediate section 102 has a width 105 of about ⅝ inches and the head 94 has a width 107 of about 1½ inches.

In the above examples, the non-limiting specifications of the milling head 18 and the fastener 44 provide for attachment of the milling head 18 to the floating base 12 and for use trimming the rigid foam layer 110, as will be described in further detail below.

Figure 9:
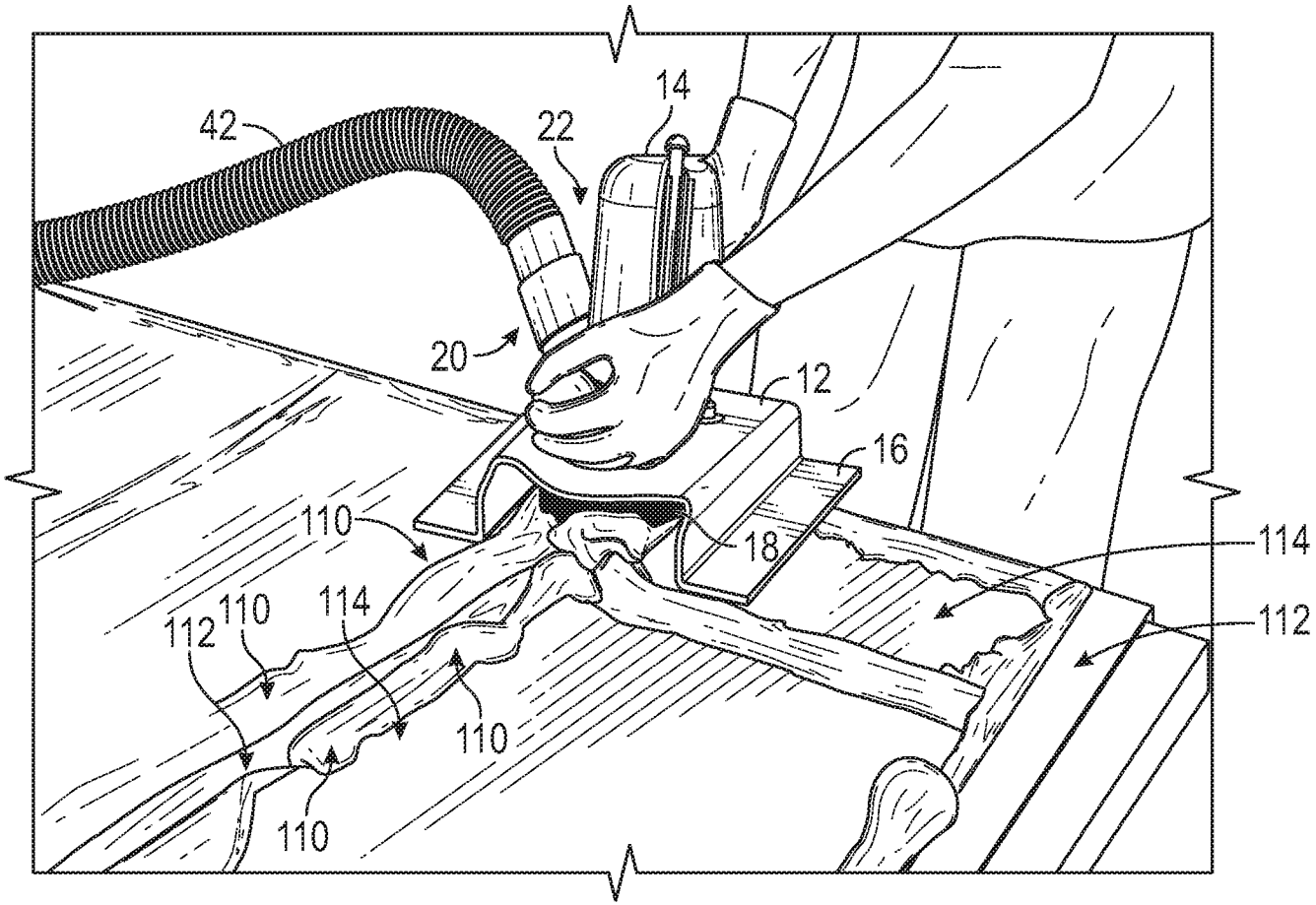
FIG. 9 is an example trimming tool and rigid foam layer.

Referring to FIG. 9, with continued reference to FIGS. 1-8, in operation, an example rigid foam layer 110 to be trimmed is created on a surface. In one example, the rigid foam layer 110 is created by applying a spray/pour foam that hardens to layer 110. However, other types of rigid foam layers 110 may be used. In one example, the rigid foam layer 110 is disposed on a surface formed by structural framing studs 112 and an insert panel 114, such as a rigid foam panel or other similar panel. The rigid foam layer 110 is applied and creates a seal between the studs 112 and insert panel 114.

The trimming tool 10 is placed on the surface. An operator activates the milling head 18 and moves the trimming tool along the surface of the structural framing studs 112 and insert panel 114 such that the protruding, uneven rigid foam layer 110 passes through the front opening 36 of the floating base 12 and enters the workspace 34. In the workspace 34, the rotating milling head 18 grinds the rigid foam layer 110 down to leave a flush surface that drywall or another finished product may be attached to, applied to, or fastened over. As the milling head 18 trims or grinds the rigid foam layer 110 flush with the structural framing studs 112, the scrap foam being eliminated is suctioned out of the collection port 20 for recycling or disposal.

Although the different embodiments have the specific components shown in the illustrations, embodiments of this disclosure are not limited to those particular combinations. It is contemplated to use some of the components or features from one of the embodiments in combination with features or components from another one of the embodiments.

The preceding description is exemplary rather than limiting in nature. Variations and modifications to the disclosed embodiments may become apparent to those skilled in the art that do not necessarily depart from the essence of this disclosure.

What is claimed is:

1. A trimming tool comprising:

a floating base having a first side and an opposite, second side, a first rail, and a second rail, the first rail and the second rail running from the first side to the second side, wherein the second side of the floating base, the first rail and the second rail define a workspace having a first opening at the first side and a second opening at the second side, wherein the second opening is defined at least in part by the first rail, the second rail and a sloped portion of the floating base, and wherein the second opening has a trailing edge at the sloped portion, and the trailing edge is above and spaced away from the first rail and the second rail; and a milling apparatus, attached to the floating base, having a milling head on the second side of the floating base, wherein the floating base and the milling apparatus are configured to remove at least a portion of a foam layer in the workspace, and wherein the milling head is spring loaded with respect to the floating base such that it is configured to float on the foam layer.

2. The trimming tool of claim 1, wherein the first rail and the second rail include linear portions to maintain the floating base against a surface.

3. The trimming tool of claim 1, wherein the first rail, the second rail, and the floating base are unitary.

4. The trimming tool of claim 1, wherein the floating base includes a collection port configured to allow millings to pass through a collection port opening and out of the workspace, wherein the collection port is connected to a tube configured to provide suction.

5. The trimming tool of claim 1, wherein the milling apparatus includes a handle and a motor configured to power the milling head.

6. The trimming tool of claim 1, wherein the milling head includes a plurality of protrusions extending about a circumference of the milling head and a guide surface that protrudes from a bottom of the milling head.

7. The trimming tool of claim 6, wherein the plurality of protrusions include spikes and the guide surface protrudes from the bottom of the milling head a length equal to the length of one of the plurality of protrusions.

8. The trimming tool of claim 6, wherein the milling head includes a protective coating.

9. The trimming tool of claim 1, wherein the milling head is disposed closer to the first opening than the second opening, wherein the first opening is configured to receive the foam layer.

10. The trimming tool of claim 1, wherein the milling head is attached to the floating base by a fastener that extends through the milling head and through an opening in the floating base.

11. The trimming tool of claim 1, wherein the first opening is configured to receive the foam layer and is wider than a diameter of the milling head.

12. The trimming tool of claim 1, wherein the trailing edge is about ¼ inch above the first rail and the second rail.

13. The trimming tool of claim 1, wherein the milling head includes a plurality of protrusions arranged in rows.

14. The trimming tool of claim 13, wherein the plurality of protrusions are selected from a group consisting of spikes, teeth, and blades.

15. The trimming tool of claim 14, wherein the plurality of protrusions include more than one type of protrusion.

16. The trimming tool of claim 1, wherein the milling head is cylindrical and has a first side adjacent the floating base, and a second side opposite the first side, and wherein the milling head includes a plurality of protrusions arranged in rows, the plurality of protrusions configured to grind the foam layer.

17. The trimming tool of claim 16, wherein the milling head includes a smooth guide surface extending from the second side, and wherein the protrusions extend from the milling head such that the protrusions terminate before the guide surface begins.

18. The trimming tool of claim 16, wherein the milling head includes a smooth guide surface extending from the second side, and wherein the guide surface extends from the second side a length equal to a length of the protrusions.

19. The trimming tool of claim 16, wherein the milling head includes an opening through its center, and a fastener attaching the milling head to the floating base.

* * * * *